United States Patent [19]

Best

[11] Patent Number: 4,989,123

[45] Date of Patent: Jan. 29, 1991

[54] COLLAPSIBLE LIGHT SHADE FOR A PORTABLE LIGHT

[76] Inventor: Christopher F. Best, 6709 New Sharon Church Rd., Rougemont, N.C. 27572

[21] Appl. No.: 500,072

[22] Filed: Mar. 27, 1990

[51] Int. Cl.[5] ..... A45B 3/02

[52] U.S. Cl. ..... 362/102; 135/20 R; 135/16; 135/DIG. 10

[58] Field of Search ..... 362/102, 806; 135/20 R, 135/20 A, 20 M, 16, DIG. 10

[56] References Cited

U.S. PATENT DOCUMENTS

| | | | |
|---|---|---|---|
| 923,542 | 6/1909 | Losey | 135/20 A |
| 2,087,537 | 7/1937 | Finkel | 362/102 |
| 4,425,602 | 1/1984 | Lansing | 362/102 |

FOREIGN PATENT DOCUMENTS

| | | | |
|---|---|---|---|
| 1088152 | 9/1954 | France | 135/16 |
| 101585 | 10/1916 | United Kingdom | 362/102 |
| 2036123 | 6/1980 | United Kingdom | 135/16 |

*Primary Examiner*—Carroll B. Dority
*Attorney, Agent, or Firm*—Richard E. Jenkins

[57] ABSTRACT

A collapsible light shade for a portable light such as a flashlight having a handle with a collapsible umbrella shade mounted at one end thereof. A collapsible leg assembly is mounted at the other end of the handle for supporting the shade in an upright free-standing position and a strap is secured to the medial portion for releasably securing a portable light to the handle with the light emitting end directed generally upwardly toward the umbrella shade.

14 Claims, 3 Drawing Sheets

COLLAPSIBLE LIGHT SHADE FOR A PORTABLE LIGHT

TECHNICAL FIELD

The present invention relates to portable lights, and more particularly relates to a collapsible light shade and stand for a portable light such as a flashlight to facilitate use at camp sites and the like.

BACKGROUND ART

Umbrellas with portable lights incorporated into the structure thereof as well as portable light assemblies adapted for mounting to a conventional umbrella are well known in the art. These devices are intended for use in a variety of applications wherein illumination is helpful such as walking in the rain or in the evening. For example, U.S. Pat. No. 4,425,602 to Lansing discloses an umbrella lamp assembly which is adapted for being removably mounted to the stem of a conventional umbrella. The lamp assembly includes a battery and light source therein, and defines a two-sided spherical body which is first opened to receive the umbrella stem and then closed thereon in order to frictionally engage the same. Most suitably, the two semi-spherical shells forming the lamp assembly are formed of transparent or translucent plastic.

U.S. Pat. No. 3,313,929 to Schiavone discloses an illuminated beach or lawn umbrella which can be used as a decorative article for evening social gatherings and similar occasions. The illuminated umbrella comprises a pole handle with a pointed lower end for placement in the sand or lawn where the umbrella is to be used. A fluorescent lamp is provided at the top of the pole and beneath the extended umbrella to provide a uniform area of light about a 360° area around the pole, and an electrical plug is provided adjacent the pointed end of the pole handle for connection to a suitable external power source. Also of interest, U.S. Pat. Nos. 4,848,385 to Pinnella and 1,707,473 to Goldberg disclose umbrellas having lamp assemblies and battery power sources incorporated into the structure of the umbrella.

However, until applicant's invention, no one has discovered a simple, collapsible umbrella shade which is adapted to be secured to a portable light such as a flashlight to adapt the portable light for use in a free-standing position on a flat surface such as a picnic table or to be hung in an upright or inverted position at a camp site to provide enhanced illumination.

DISCLOSURE OF THE INVENTION

In accordance with the present invention, applicant provides a collapsible light shade and stand for use in combination with a portable light to adapt the portable light for use as a free-standing or hanging light at a picnic site and the like. The collapsible light shade comprises an elongate handle, a collapsible shade mounted at one end of the handle, collapsible support means mounted at the other end of the handle for supporting the handle and shade in an upright position, and securement means attached to the handle at a medial location between the ends thereof and adapted to releasably secure a portable light such as a flashlght to the handle so that the portable light will be directed generally upwardly toward the shade.

It is therefore an object of the present invention to provide a collapsible light shade for a portable light such as a flashlight which will facilitate use of the flashlight as a free-standing table lamp.

It is another object of the present invention to provide a collapsible light shade for a portable light such as a flashlight which will enable the light to be used as a hanging light as desired.

It is another object of the present invention to provide a collapsible light shade for a portable light such as a flashlight which serves to diffuse the light emanating from the portable light and better illuminate the area surrounding the portable light.

It is yet another object of the present invention to provide a collapsible light shade for a portable light such as a flashlight which is small and lightweight for ease of transportation and storage when not in use.

Some of the objects of the invention having been stated, other objects will become evident as the description proceeds, when taken in connection with the accompanying drawings.

BEST MODE FOR CARRYING OUT THE INVENTION

Figure 1:
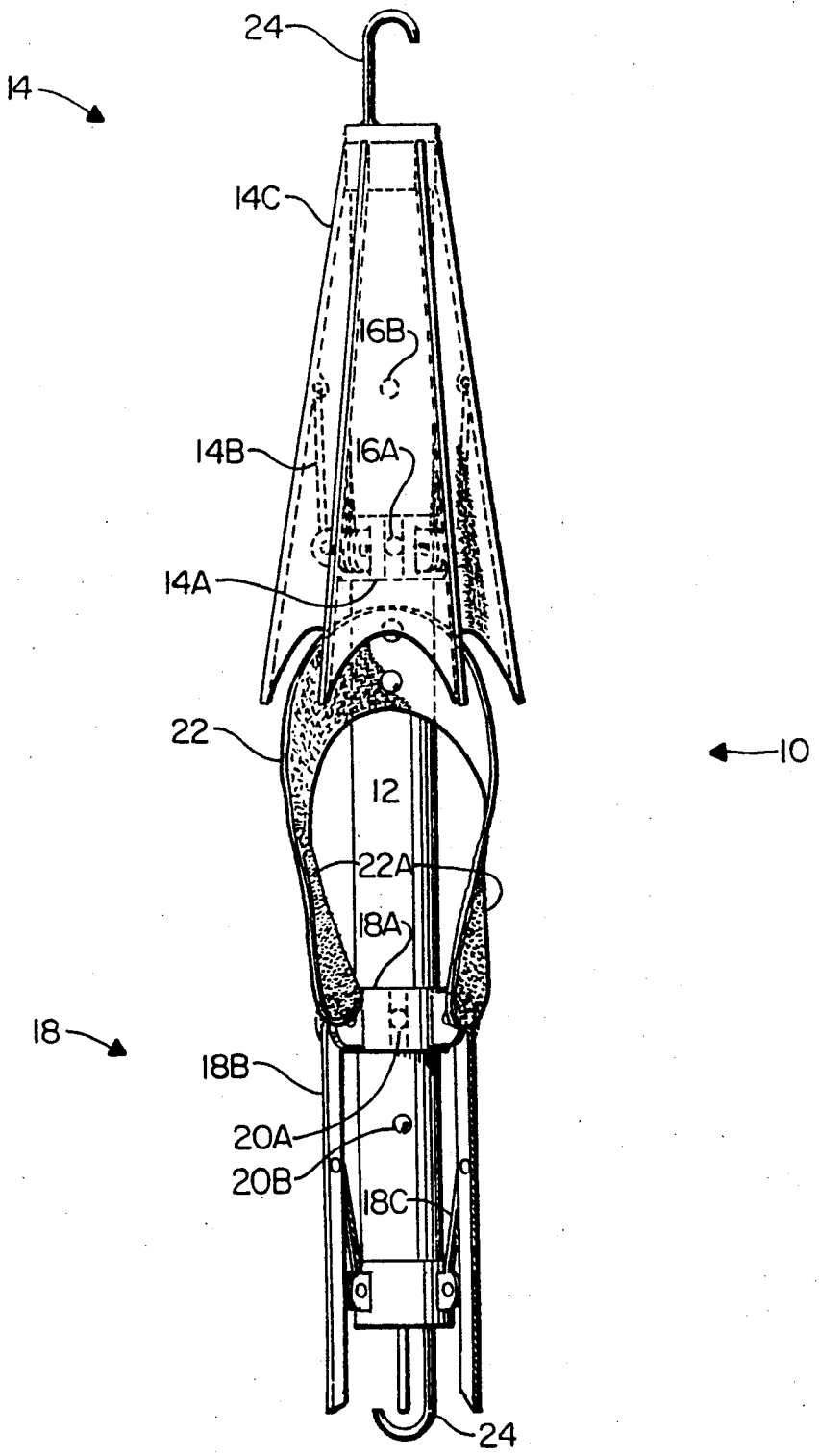
FIG. 1 is a side elevation view of the collapsible light shade of the present invention in its collapsed mode for carrying and storage.
Figure 2:
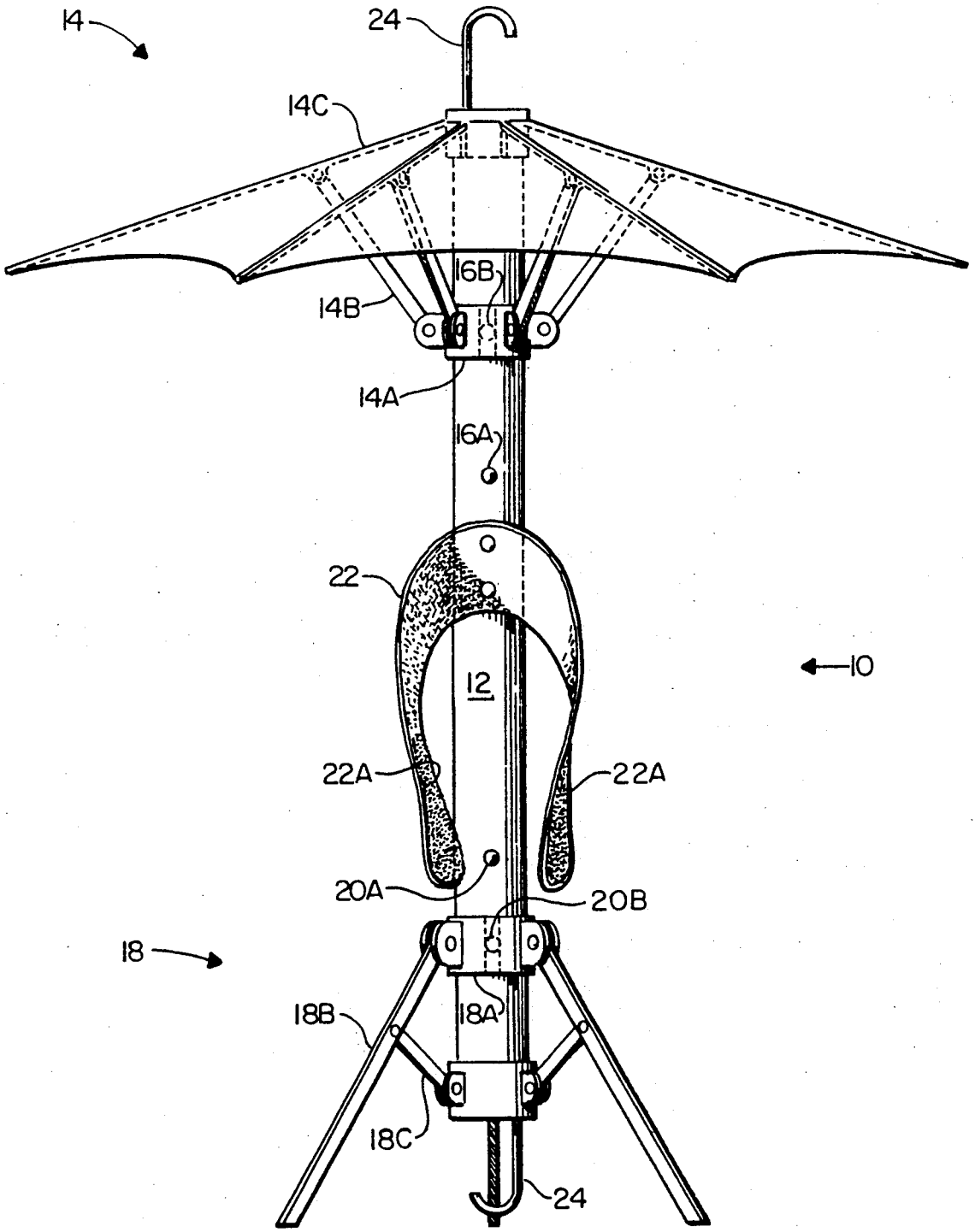
FIG. 2 is a side elevation view of the collapsible light shade of the present invention in its open mode wherein it is ready to receive a portable light such as a flashlight.
Figure 3:
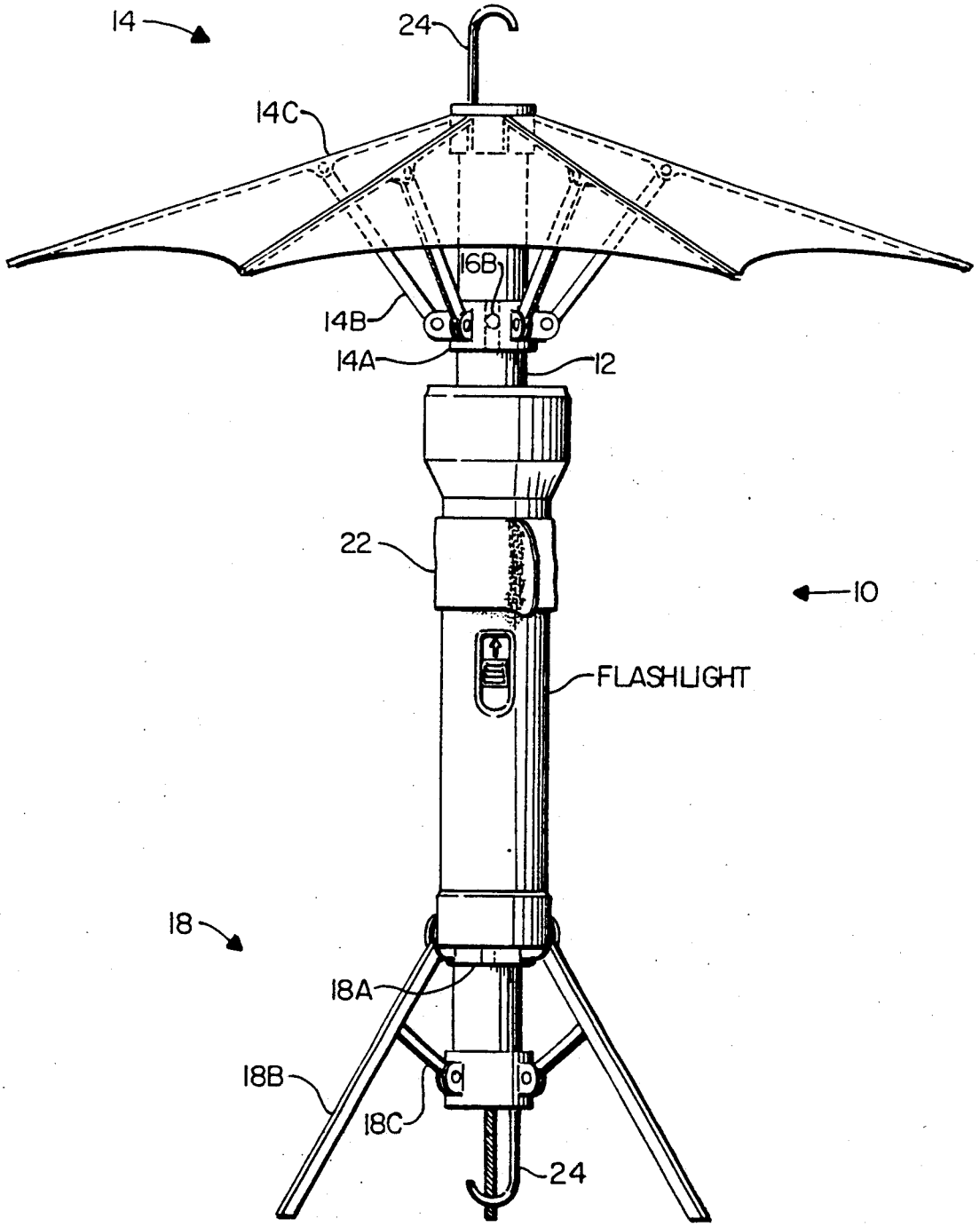
FIG. 3 is a side elevation view of the collapsible light shade of the present invention in its intended application with a flashlight secured thereto.

Referring now to FIGS. 1–3 of the drawings, the collapsible light shade of the invention is generally designated 10 therein. Collapsible light shade 10 includes handle 12 with collapsible umbrella shade 14 secured at the top end thereof. Collapsible umbrella shade 14 is of a conventional construction with central sleeve 14A mounted on handle 12 and moveable from a lower closed position wherein it is engaged by biased detente 16A to an upwardly spaced-apart position on handle 12 where it is engaged by biased detente 16B in order to secure umbrella shade 14 in an open position. Umbrella shade 14 further includes a plurality of collapsible supports 14B connected at one end to central sleeve 14A and at the other end to shade supports 14C.

At the lower end of handle 12, a collapsible leg assembly 18 is attached and includes central sleeve 18A which slides on handle 12 from a fully collapsed position wherein it is releasably engaged by biased detente 20A to a lower spaced-apart position on handle 12 where it is releasably engaged by biased detente 20B which engages central sleeve 18A when the leg assembly is in its open and fully extended position. The leg assembly further includes a plurality of pivotably mounted legs 18B extending downwardly and outwardly from central sleeve 18A and which are attached at their respective lower ends to handle 12 by collapsible support arms 18C.

A strap 22 is secured to the middle of handle 12 and includes mating VELCRO portions 22A at each end thereof to facilitate securement of strap 22 about a flashlight or similar portable light to be used in combination with collapsible light shade 10 of the invention. Also, most suitably a hook 24 is attached to each end of handle 12 to facilitate hanging of light shade 10 in an upright or inverted position from a suitable support such as a tree or the inside of a tent at a camp site. Thus, collapsible light shade 10 may be either placed on a flat surface and supported by leg assembly 18 in a free-standing position or hung by one of hooks 24 as desired by the user.

Although collapsible light shade 10 may be constructed of many different types of material, applicant presently contemplates that plastic would be most suitable with the covering of umbrella shade 14 being constructed of an opaque nylon fabric to best diffuse light from a portable light secured to handle 12 thereof. Also, although other sizes are possible, applicant presently believes that most suitably handle 12 should be about 8–12 inches in length and umbrella shade 14 should define a diameter of about 8–12 inches when fully opened. Even more desirably, handle 12 should be about 10 inches in length and umbrella shade 14 about 10 inches in diameter in the preferred embodiment of the invention for use in combination with a conventional flashlight secured thereto with the lamp end directed upwardly into the inside of umbrella shade 14 (see FIG. 3).

It will thus be seen that there has been described above a collapsible light shade for a portable light such as a flashlight which converts the flashlight into a free-standing lamp or hanging lamp to provide a safe source of diffuse light for camping or during emergencies such as blackouts or evening automotive failures when a lamp is required to work on the automobile.

It will be understood that various details of the invention may be changed without departing from the scope of the invention. Furthermore, the foregoing description is for the purpose of illustration only, and not for the purpose of limitation—the invention being defined by the claims.

What is claimed is:

1. In combination, a collapsible multi-purpose stand and a flashlight attached thereto comprising:

an elongate handle;

collapsible shade means mounted at one end of said handle, said shade means located adjacent a light emitting end of said flashlight;

collapsible support means mounted at the other end of said handle for supporting said handle and shade means in an upright position, said support means adapted to be adjacent the non-light emitting end of said flashlight; and securement means attached to said handle at a medial location between said ends thereof and adapted to releasably secure said flashlight to said handle so that said flashlight will be directed generally upwardly toward said shade means.

2. A collapsible muti-purpose stand for a portable light comprising:

an elongate handle having a length between about 8–12 inches;

collapsible shade means mounted at one end of said handle having an open diameter between about 8–12 inches, said shade means adapted to be adjacent the light emitting end of a portable light secured to said collapsible stand;

a plurality of collapsible support legs mounted at the other end of said handle for supporting said handle and shade means in an upright position, said support legs adapted to be adjacent the non-light emitting end of a portable light secured to said collapsible stand;

securement means attached to said handle at a medial location between said ends thereof and adapted to releasably secure a portable light to said handle so that the portable light will be directed generally upwardly toward said shade means; and a hook secured to at least one of the opposing ends of said handle to facilitate hanging said light stand with a portable light secured thereto;

whereby a portable light may be attached to said collapsible stand for use as a conventional table lamp, hanging lamp or the like.

3. A collapsible stand according to claim 1 wherein said handle extends for a length of about 8–12 inches and said collapsible shade means defines a diameter of about 8–12 inches when fully opened.

4. A collapsible stand according to claim 1 wherein said collapsible shade means comprises an opaque nylon fabric.

5. A collapsible stand according to claim 1 wherein said collapsible shade means is adapted to be selectively moved from a releasably secured collapsed position to a releasably secured extended position.

6. A collapsible stand according to claim 1 wherein said collapsible support means comprises a plurality of support legs which are adapted to be selectively moved from a releasably secured collapsed position to a releasably secured extended position.

7. A collapsible stand according to claim 1 wherein said securement means comprises an elongate strap attached to and extending generally perpendicularly from the lengthwise axis of said handle and including VELCRO closure means for releasably securing a portable light to said handle.

8. A collapsible stand according to claim 1 wherein said collapsible light stand further comprises a hook at each of the opposing ends of said handle to facilitate hanging of said light stand with a portable light secured thereto in an upright or in an inverted position.

9. A collapsible stand according to claim 2 wherein said collapsible shade means comprises an opaque nylon fabric.

10. A collapsible stand according to claim 2 wherein said collapsible shade means is adapted to be selectively moved from a releasably secured collapsed position to a releasably secured extended position.

11. A collapsible stand according to claim 2 wherein said plurality of collapsible support legs are adapted to be selectively moved from a releasably secured collapsed position to a releasably secured extended position.

12. A collapsible stand according to claim 2 wherein said securement means comprises an elongate strap secured to and extending generally perpendicularly from the lengthwise axis of said handle and including VELCRO closure means for releasably securing a portable light to said handle.

13. A collapsible stand according to claim 2 wherein said light stand comprises a hook secured at each of the opposing ends of said handle to facilitate hanging of said light stand with a portable light secured thereto in an upright or in an inverted position.

14. A collapsible stand according to claim 2 wherein said elongate handle has a length of about 10 inches and said collapsible shade means has a fully opened diameter of about 10 inches.

* * * * *